US005178335A

United States Patent [19]

Mertens

[11] Patent Number: 5,178,335

[45] Date of Patent: Jan. 12, 1993

[54] MILL

[76] Inventor: Theo Mertens, Zollstrasse 2, 4712 Werne, Fed. Rep. of Germany

[21] Appl. No.: 753,809

[22] Filed: Sep. 3, 1991

Related U.S. Application Data

[63] Continuation-in-part of Ser. No. 566,899, Aug. 13, 1990, abandoned, which is a continuation of Ser. No. 344,245, Apr. 27, 1989, abandoned.

[30] Foreign Application Priority Data

Apr. 27, 1988 [DE] Fed. Rep. of Germany ..... 3814191

[51] Int. Cl.[5] ..... B02C 13/04

[52] U.S. Cl. ..... 241/73; 241/79.2; 241/101.2; 241/189.1; 366/311

[58] Field of Search ..... 241/189 A, 189 R, 191, 241/194, 185 R, 73, 79.2, 166, 86, 101.8, 101.2; 366/309, 311, 312

[56] References Cited

U.S. PATENT DOCUMENTS 1,846,683 2/1932 Hammond ..... 241/38 X
1,871,489 8/1932 Ammon ..... 241/189 R
2,564,096 8/1951 Clay et al. ..... 241/166 X
2,711,964 6/1955 Wiemer ..... 241/166 X

FOREIGN PATENT DOCUMENTS 361762 3/1981 Austria .

*Primary Examiner*—Joseph M. Gorski
*Attorney, Agent, or Firm*—Anderson Kill Olick & Oshinsky

[57] ABSTRACT

The mill comprises a housing 1, in which a cylindrical sieve drum is arranged which can be loaded with grain from the top through a charging opening. A driven rotor is arranged inside the sieve drum, beaters being articulated at the rotor. The beaters are arranged in pairs, as seen in the rotating direction of the rotor, wherein the material is first lifted from the drum wall by means of a guiding beater which runs in front and is directed to a rebound beater running behind, which beats the material and throws it back to the sieve drum wall. The ground material passing out of the sieve drum is carried away via a discharge opening at the underside of the housing.

3 Claims, 4 Drawing Sheets

MILL

This is a continuation-in-part application of U.S. Ser. No. 07/566,899, filed Aug. 13, 1990, and now abandoned, which in turn is a continuation application of U.S. Ser. No. 07/344,245, filed Apr. 27, 1989 and now abandoned.

The invention is directed to a mill, particularly a hammer mill according to the features in the preamble of claim 1.

Mills of this type are used, for example, for the processing of grain to form livestock feed.

A known mill of this type comprises a housing in which is arranged a sieve drum with horizontal axis. A driven rotor is provided inside the stationary sieve drum so as to be arranged coaxially relative to it, beaters in the form of narrow plates being articulated at the rotor. In operation, the free ends of the beaters run in close proximity to the drum wall, beat the material to be ground, which is poured into the drum through a charging opening, and press it through the sieve openings of the drum. The material to be ground, which is beaten until at least partially mealy, passes out of the sieve drum in accordance with the dimensioning of the perforations and is discharged from the interior of the housing in a downward direction.

A disadvantage in this known type of construction is that the beaters only partially beat the grinding material to be reduced and, for the rest, squeeze it through the sieve drum. The material to be ground runs within the sieve drum substantially in the wall area, wherein the beaters, with their free ends, move through this layer and possibly deflect. As a result of the high friction which occurs by means of this, the grinding material to be reduced has a high dusty proportion on the one hand and, on the other hand, a high drive output is required in order to overcome this friction. Particularly in the production of livestock feed, where hammer mills of this type are used, a high dusty proportion of the ground material is undesirable, since it does not agree with the livestock. It is precisely in the reduction of grain to form livestock feed that only a beating of the individual grains, if possible, and not a grinding, is desired.

In addition to the comparatively high expenditure of energy for driving such a hammer mill, another disadvantage consists in that the sieve clogs relatively quickly, so that the material to be ground, which is already beaten into the desired grain size, can not pass through the sieve. The material to be ground is accordingly further reduced in an undesirable manner, so that there is a high dusty proportion of the ground material.

A hammer mill for reducing and separating grinding products consisting of various materials is known from the DE-PS 11 33 221, which hammer mill is provided with an elongated housing comprising a material inlet at one end, a hammer rotor which is provided with a sieve on its underside and comprises differently shaped hammers being arranged in the housing.

This hammer mill can be used for separating crushed stems or stalks e.g. of dried sugar cane, Chinese sugar cane, bamboo, reeds, corn stalks and the like, so as to separate their fibrous and pulp components from one another, as well as for separating high-quality and other fibrous materials which are mixed with cement.

The rotor is divided into a grinding zone and an adjoining beating zone proceeding from the inlet end. The hammers of the grinding zone consist of a plurality of hammer groups which are distributed adjacent to one another along the length of the rotor, each group comprising grinding, lifting and conveying hammers, whereas the hammers of the beating zone comprise beaters which enable a careful treatment of the coarse material passing through the beating zone; that is, they are fashioned in such a way that they do not substantially separate the coarse material, but substantially serve only to divide the already present fine material adhering to the coarse material.

In the grinding zone, one kind of hammer serves primarily to produce the grinding effect, another type serves primarily to convey and loosen the mixture which is guided through the grinding zone.

The grinding hammers are provided with convex hammer surfaces and the lifting hammers are provided with spoon-like hammer heads, while the end faces of the hammer heads of the conveying hammers are beveled toward the delivery end. In addition, the hammers are arranged in such a way with respect to the adjacent groups that the grinding hammers, the lifting hammers and the conveying hammers of adjacent groups are offset relative to one another in the circumferential direction. The grinding hammers, the lifting hammers and the conveying hammers of adjacent groups can be arranged on a helical line in the course of the grinding zone.

Proceeding from the mill described in the preamble of claim 1, the invention has the object of constructing the latter with simple means in such a way that the material to be ground, particularly grain, is extensively beaten in the mill and not crushed, accompanied by a comparatively low expenditure of energy.

This object is met, according to the invention, by means of the features indicated in the characterizing part of claim 1.

The guiding beater runs in close proximity to the drum wall and shells the material located in the area of the drum wall, specifically in such a way that it is guided toward the rebound beater arranged behind it. The rebound beater is constructed in such a way that the material lifted by the guiding beater impacts on the rebound beater at an acute angle, is beaten and thrown back in the direction of the drum wall. To the extent that the material is already beaten to the desired grain size, it passes out through the sieve recesses in the sieve drum. Larger grains are engaged by the following guiding beater and fed in turn to the rebound beater in the same way as described above.

It should be noted with respect to the angular dimensioning of the guiding plate of the guiding beater and the rebound plate of the rebound beater that it can vary within a wide range depending on the design of the mill and on the material to be processed. Factors having influence on this are the rate of rotation of the rotor, the radius of the sieve drum, the material to be processed and the throughput quantity. It is indicated here by way of example that the surface of the guiding plate which faces the drum wall can have an acute angle of approximately 30° relative to the tangent line of the drum, and the surface of the rebound plate can have an acute angle of approximately 60° relative to the tangent line of the drum (tangent line in the imaginary point of contact of the beater at the drum).

A further development according to claim 2 is advantageous. The supporting member and plate can be connected with one another, e.g. by means of welding. On the one hand, this construction allows a relatively light construction of the beaters, which means a low loading of the rotor and particularly of the bearing receiving the rotor. Almost the entire drum width can be comprehended by means of the plates at the end of the supporting member without a fanning effect occurring in the remaining area of the drum, since the air in the area of the relatively narrow supporting member can circulate freely. Accordingly, the relative speed between the material located in the drum and the beaters is increased in an advantageous manner, so that the material strikes the plates at high speed and is beaten.

The beaters are preferably supported so as to be articulated to a limited extent at an axle of the axles provided at the rotor, so that they can deflect to the rear along a certain area during operation if they encounter impediments such as small stones or the like. After overcoming such an impediment, the beaters then automatically return to their provided working position due to the centrifugal force. Premature wear or damage to the mill by foreign bodies can accordingly be prevented on the one hand, an effective protection against overloading of the rotor and drive is formed on the other hand.

The guiding plate of the guiding beater is arranged in an advantageous manner according to claim 3. During the operation of the mill, that is, during the rotation of the rotor by means of the centrifugal force, it is aligned in such a way that its front edge, as seen in the direction of rotation, runs in close proximity to the drum wall. The guiding plate which runs past in proximity to the drum wall lifts the material located in the area of the drum wall and guides it along this plate toward the rear, as seen in the direction of rotation, where it then strikes the rebound beater, is beaten and thrown back in the direction of the sieve drum. This arrangement of the guiding plate enables a lifting of the material from the drum wall accompanied by slight friction resistance and extensively prevents a crushing of the material between the guiding plate and drum wall.

The rebound beater is advisably constructed in a corresponding manner as indicated in claim 4. The rebound plate of the rebound beater is arranged in such a way that during the rotation of the rotor by means of centrifugal force it positions itself in such a way that its rear edge, as seen in the direction of rotation, runs in close proximity to the drum wall. The material whirled up by the guiding beater is beaten at this rebound plate and thrown back in the direction of the drum wall. Since the rebound plate extends until close to the drum wall, the material which was not lifted by means of the guiding plate or which has already moved again into the area of the drum wall is also engaged.

A plurality of guiding or rebound beaters can be arranged adjacent to one another on a rotor axle. However, it is preferable that only one guiding beater or one rebound beater, respectively, which extends along the entire drum width, be articulated on every axle. This offers the advantage that the material is engaged and beaten along the entire drum width. A construction according to claim 5 is advantageous on the one hand in order to enable this continuous brushing over the drum wall by means of the guiding or rebound beater, respectively, and, on the other hand, in order to avoid a fanning effect, which is disadvantageous per se, due to air guided between the individual beaters. The air located within the drum can therefore circulate freely between the rotor and plates around the narrow supporting members located therein. Moreover, such a construction is favorable with respect to manufacturing technology, since, as a whole, fewer individual parts need to be provided. A guiding or rebound plate can be articulated at the respective axle on the rotor, e.g. via two supporting members provided in the outer area.

The invention is explained in more detail in the following by means of an embodiment example shown in the drawings.

Figure 1:
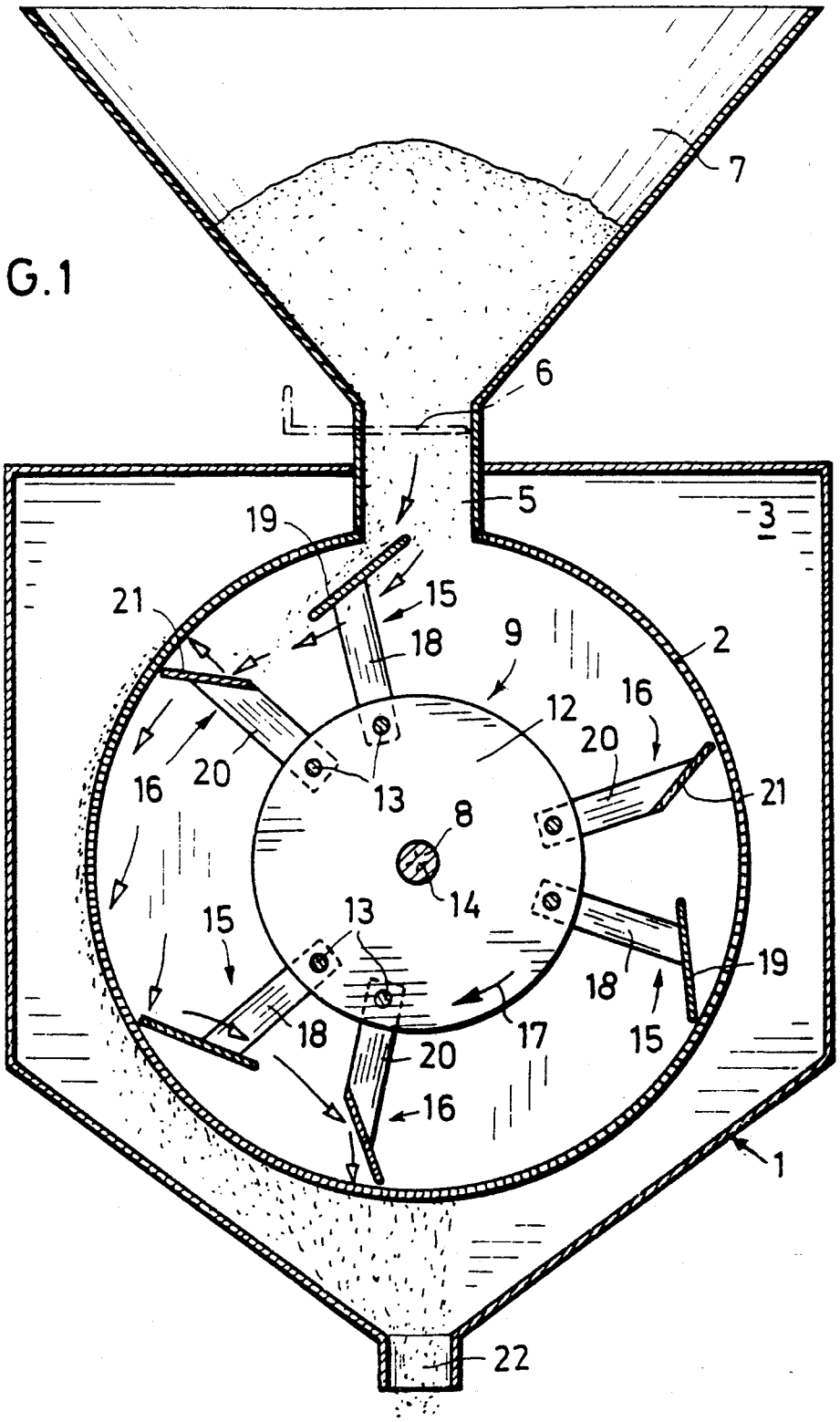
FIG. 1 shows a greatly simplified view of a section through a hammer mill, transversely relative to the drum axis.
Figure 2:
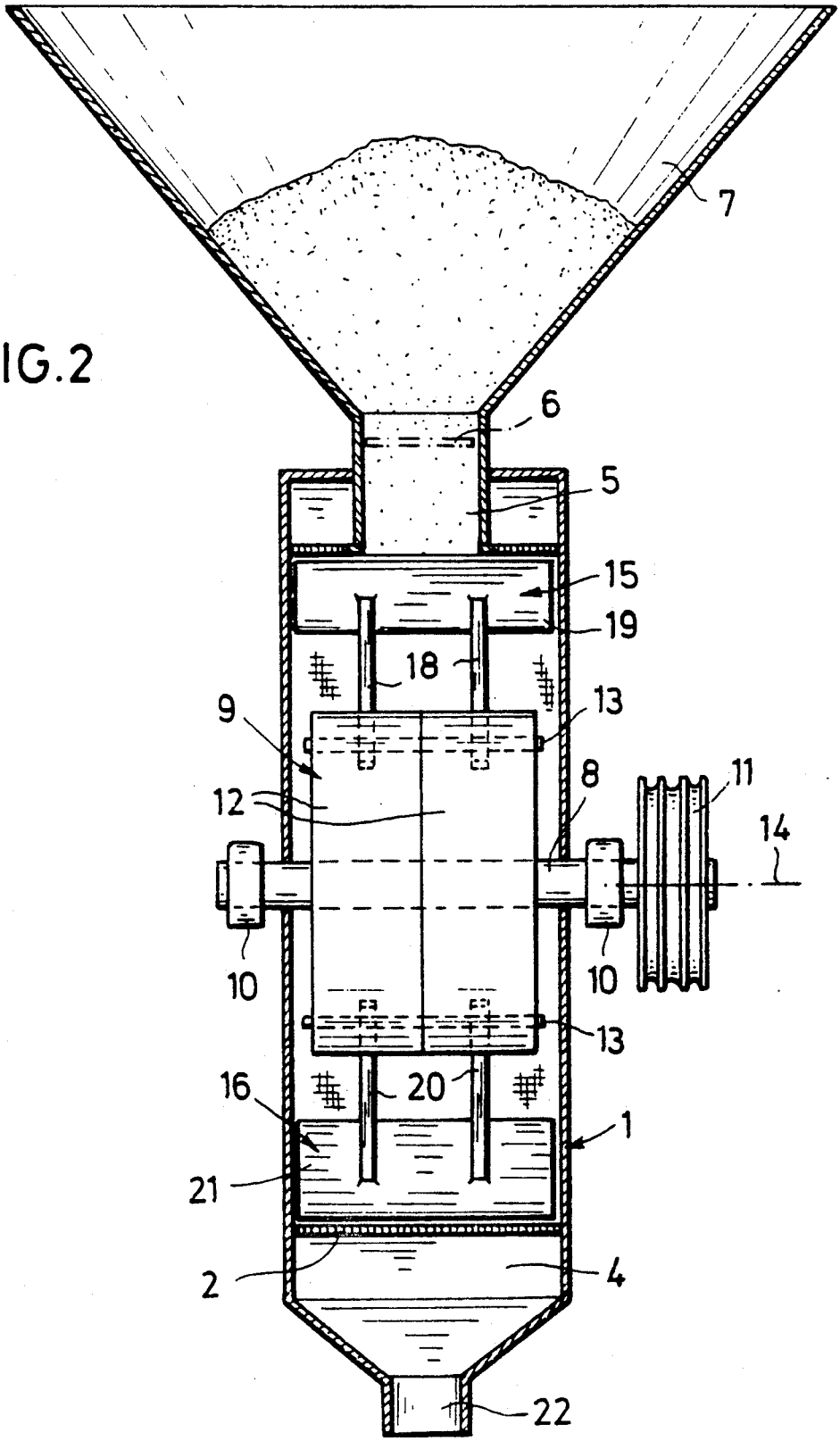
FIG. 2 shows a section of the mill along the drum axis.

The drawings serve exclusively to explain the construction and manner of operation of the mill. They are not drawn to scale and are also greatly simplified.

The hammer mill which is shown comprises a housing 1 in which a cylindrical sieve drum 2 is arranged. The sieve drum 2 is formed by means of a sieve which is arranged cylindrically between the walls of the housing 1 and is closed laterally by means of the housing walls 3. The sieve drum 2 is arranged at a distance from the housing walls 4 and comprises a charging opening 5 at its upper surface which is entirely or partially closable by means of a slide 6.

The charging opening 5 is guided through the upper side of the housing 1 and simultaneously forms the discharge opening of a reservoir container 7 which sits on the upper side of the mill housing 1.

The housing walls 3 are penetrated approximately in the center by a shaft 8 of a rotor 9. The shaft 8 is supported in bearings 10 at the outside of the housing 1 and comprises a belt pulley 11 at its end, the mill being connectable with a drive unit via the latter.

The rotor 9 comprises two disks 12 which are securely connected with the shaft 8, axles 13 being fastened between the disks 12 in the vicinity of their outer circumference. The axles 13 are arranged parallel to the rotational axis 14 of the shaft 8. As shown in the section according to FIG. 1, the axles 13 all lie at the same radial distance relative to the rotational axis 14 and are arranged so as to be distributed in pairs along the circumference.

A guiding beater 15 or a rebound beater 16, respectively, is supported at every axle 13 so as to be articulated to a limited extent. As seen in the rotating direction 17 of the rotor 9, guiding beaters 15 and rebound beaters 16 are arranged in pairs, respectively, corresponding to the distribution of the axles, wherein the guiding beater 15 lies in front of the rebound beater 16 as seen in the rotating direction 17.

Every guiding beater 15 comprises two supporting members 18 and a guiding plate 19 fastened thereon. The supporting members 18 are constructed in a rod-shaped manner and are articulated at one end at the respective axle 13. The guiding plate 19 which connects the supporting members 18 is welded on at the free outer end of the supporting members 18. The guiding plate 19 is arranged in such a way that it is freely swivelable inside the sieve drum 2 and runs with the front edge in close proximity to the sieve drum 2 in its operating position. In this construction, the guiding plate 19 forms an acute angle of approximately 30° with the tangent line of the sieve drum 2 at this point in the shown operating position (FIG. 1).

Every rebound beater 16 likewise comprises two supporting members 20 and a rebound plate 21 which connects the latter. In this instance, also, the rod-shaped supporting members 20 are articulated at the respective axle 13 by one end and are welded with the rebound plate 21 at their other end. The rebound plate 21 is arranged in such a way that it runs with its rear edge in close proximity to the sieve drum wall in the operating position. The rebound plate 21 forms an angle of approximately 60° with the tangent line of the sieve drum 2 at this point, which angle opens in the rotating direction 17.

During the operation of the hammer mill, the shaft 8 of the rotor 9 is driven in the rotating direction 17 via the belt pulley 11 and a drive machine connected therewith, not shown. The guiding beaters 15 and the rebound beaters 16 are aligned approximately radially because of the centrifugal force, as shown in FIG. 1. The front edges of the guiding plates 19 and the rear edges of the rebound plates 21 run in close proximity to the sieve drum wall. By opening the slide 6, the material located in the reservoir container 7, e.g. grain, reaches the sieve drum 2 via the charging opening 5. Because of the force of gravity, centrifugal force and air whirling within the sieve drum 2, the material which is poured into the drum 2 describes a path close to the drum wall, as is illustrated in FIG. 1 by means of the arrows. In so doing, it is lifted from the drum wall by means of the guiding plate 19 of the guiding beater 15 and is carried away to the rear, as seen in the rotating direction 17, via the guiding beater 19 because of its mass inertia. The rebound beater 16 lies close behind the guiding beater 15 and the material impacts on its rebound plate 21. The mass flow of the material to be ground, which is indicated by means of arrows in FIG. 1, runs approximately tangentially in the area between the guiding beater 15 and the rebound beater 16, so that the material strikes the rebound plate 21 at an angle of approximately 45°. A majority of the material is beaten and thrown back in the direction of the sieve drum 2 by means of the impact. The particles which are already beaten until sufficiently small pass outward through the sieve openings into the area between the housing 1 and the sieve drum 2. The larger particles are at least partially thrown toward the sieve drum and likewise beaten by means of rebounding on the rebound plate 21. This process is repeated continuously by means of the following beater pairs 15, 16. In so doing, the material is continuously fed out of the reservoir container 7 and the beaten grain is carried away via a discharge opening 22 at the underside of the housing 1.

Figure 3:
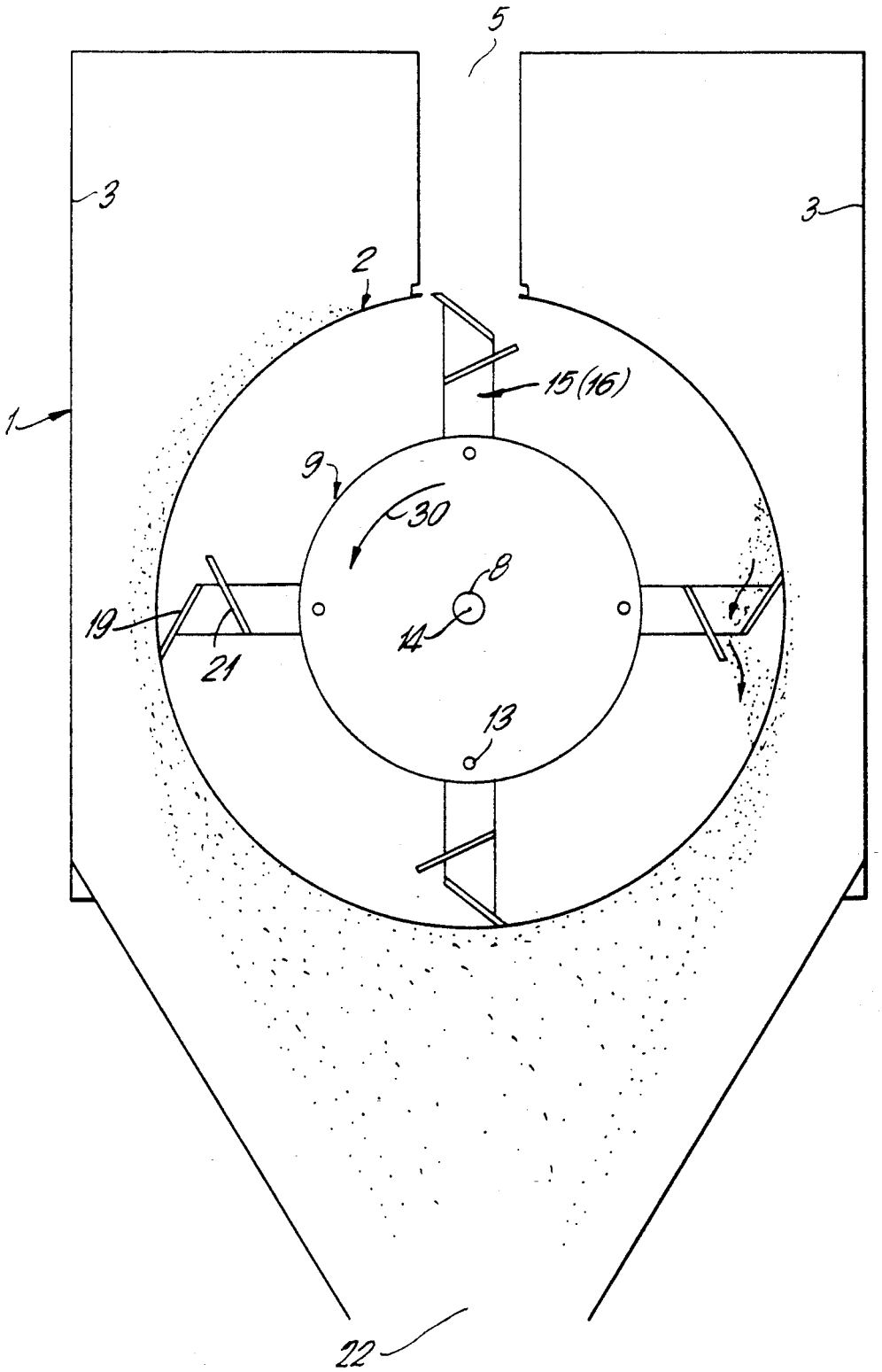
FIG. 3 is a view similar to FIG. 1 of a second embodiment of a hammer mill.
Figure 4:
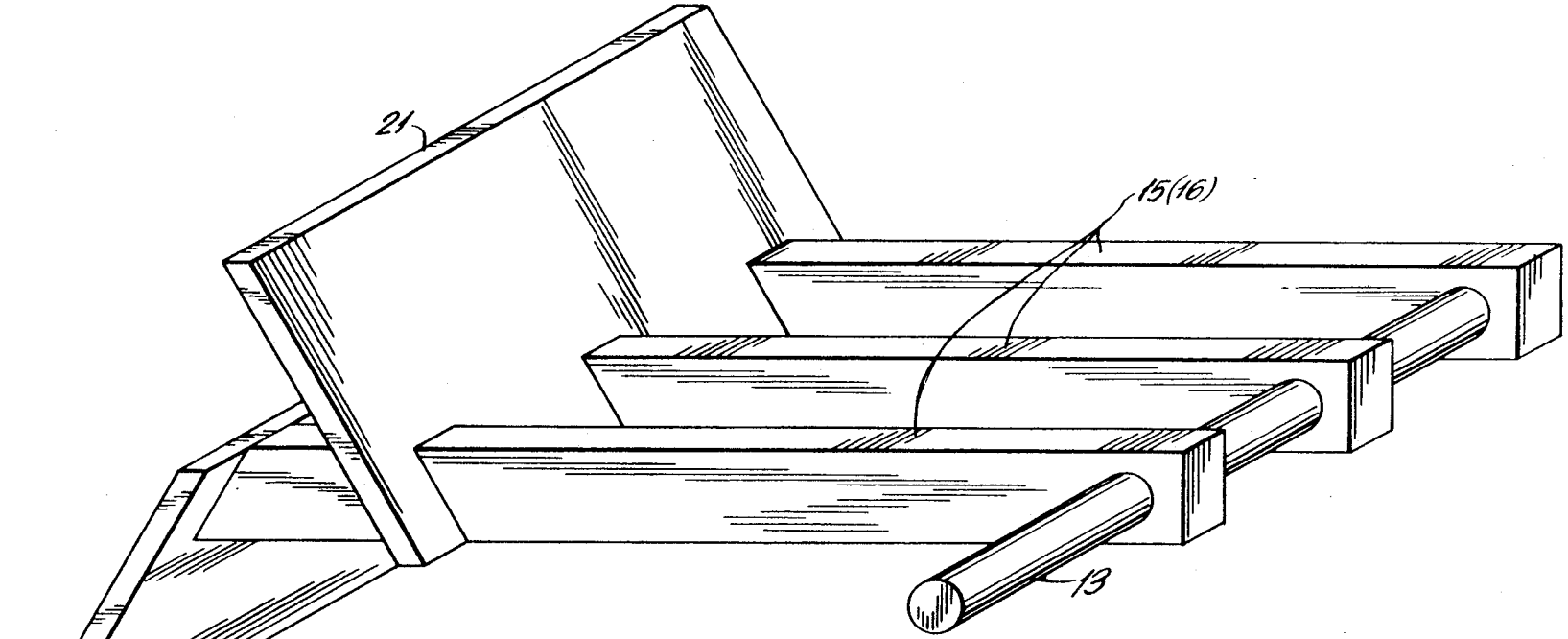
FIG. 4 is an isometric view of the guiding and rebound beaters in FIG. 3.
Figure 5:
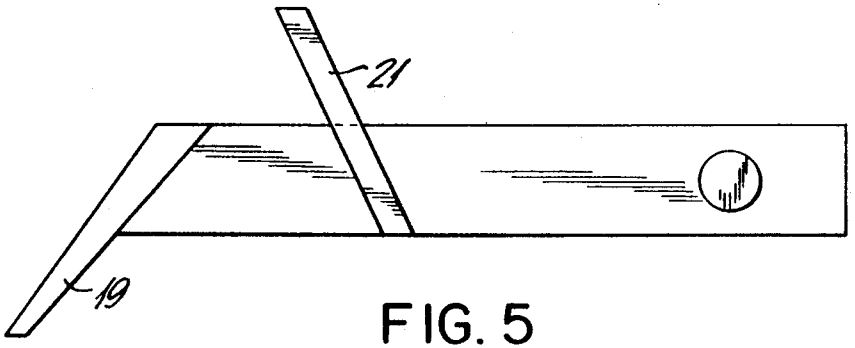
FIG. 5 is a side view of FIG. 4.

In a further embodiment illustrated in FIGS. 3-5, the pairs of guiding beaters 15 and rebound beaters 16 are replaced by single guiding/rebound beaters 15(16) which are each attached to the rotor 9 by an axle 13. The guiding plate 19 is fixed at the end of the supporting members 18 at an acute angle to a tangent line of the drum 2, as discussed previously in connection with FIG. 1, and so that it is in close proximity to and freely movable inside the drum 2. The rebound plate 21 is mounted on the same supporting members as the guiding plate 19, at a point radially nearer the axle 13 than the location of the guiding plate 19. As with the embodiment in FIG. 1, the rebound plate 21 is arranged so as form an angle of approximately 60° with the tangent line of the sieve drum 2, which angle opens in the direction of rotation 30.

The operation of the embodiment in FIGS. 2-5, and the cooperation between the rebound plate 21 and the guiding plate 19, is the same as was previously discussed in connection with FIG. 1.

I claim:

1. A hammer mill, for processing a material, comprising a housing and a cylindrical sieve drum whose entire wall is a sieve, which drum is arranged inside and surrounded by said housing and has a horizontal axis and comprises a charging opening and a rotor which is arranged coaxially inside said drum so that said drum surrounds said rotor with said rotor having an axis of rotation, guiding beaters which lift the material from the wall of the drum, and rebound beaters, which beat the material, the guiding beaters and rebound beaters being articulated to the rotor in defined pairs by at least one common supporting member which is connected at one end by an axle (13) to the rotor (9), and each pair of beaters comprising a rearwardly oriented rebound plate, and a foremost guiding plate (19) attached to an end of the supporting member opposite to the one end at an acute angle relative to a line tangent to the drum during operation of the mill, the guiding plate having a leading end and a trailing end relative to the direction of rotation, with the trailing end being located radially closer to the axis of rotation than is the leading end and with the leading end being in close proximity to the drum wall so as to guide the material lifted from the drum wall in a directed manner to a surface of the rearwardly oriented rebound plate (21), the rebound plate being connected to the common supporting member at a point between the guiding plate (19) and the axle (13) so that the surface of the rear rebound plate (21) is oriented at an acute angle relative to the tangent line of the drum and closely follows the guiding plate, the rebound plate having a leading edge and a trailing edge relative to the direction of rotation, with the leading edge being located radially closer to the axis of rotation than is the trailing edge so that the rebound plate beats and throws the material toward the sieve drum (2).

2. The mill according to claim 1, wherein said trailing edge of the rebound plate (21) runs in close proximity to the drum wall.

3. The mill according to claim 1, wherein at least one of the guiding plate (19) and the rebound plate (21) extends along the entire drum width.

* * * * *